US005969688A

United States Patent [19]

Ireland

[11] Patent Number: 5,969,688

[45] Date of Patent: Oct. 19, 1999

[54] CELLULAR PHONE ANTENNA WITH REACTANCE CANCELLATION

[76] Inventor: Frank E. Ireland, 7425 SW. 34th Street Rd., Miami, Fla. 33155

[21] Appl. No.: 08/898,173

[22] Filed: Jul. 22, 1997

Related U.S. Application Data

[63] Continuation of application No. 08/583,869, Jan. 5, 1996, abandoned, which is a continuation-in-part of application No. 08/233,071, Apr. 26, 1994, abandoned.

[51] Int. Cl.[6] ..... H01Q 1/24

[52] U.S. Cl. ..... 343/749; 343/702; 343/722

[58] Field of Search ..... 343/749, 750, 343/702, 722; H01Q 1/24

[56] References Cited

U.S. PATENT DOCUMENTS

| | | | |
|---|---|---|---|
| 2,648,771 | 8/1953 | Cork | 343/722 |
| 3,165,751 | 1/1965 | Roll | 343/749 |
| 3,474,453 | 10/1969 | Ireland | 343/750 |
| 4,086,596 | 4/1978 | Gauss et al. | 343/715 |
| 4,238,799 | 12/1980 | Parfitt | 343/715 |
| 4,730,195 | 3/1988 | Phillips et al. | 343/792 |
| 4,940,989 | 7/1990 | Austin | 343/749 |
| 5,214,434 | 5/1993 | Hsu | 343/702 |
| 5,214,437 | 5/1993 | Hensler | 343/720 |

FOREIGN PATENT DOCUMENTS

| | | | |
|---|---|---|---|
| 0151838 | 11/1981 | Germany | 343/749 |

*Primary Examiner*—Michael C. Wimer
*Attorney, Agent, or Firm*—Malin, Haley, DiMaggio & Crosby, PA

[57] ABSTRACT

An improved antenna for use with a hand-held, portable cellular telephone in the 800 to 900 megacycle range for greatly increasing the range and signal efficiency of transmission and receipt, eliminating dead spots, and for reducing or eliminating ground radiation on the user while the device is being used, wherein the antenna includes matched input impedance, a resonance circuit of capacitance and inductance, and a high impedance connected to the end of the antenna radiating element. The high impedance allows the device to be voltage-fed from a single element, altering the radiation pattern both for transmission and receipt.

17 Claims, 1 Drawing Sheet

CELLULAR PHONE ANTENNA WITH REACTANCE CANCELLATION

This application is a continuation of application Ser. No. 08/583,869, filed Jan. 5, 1996, now abandoned, which is a continuation-in-part of application Ser. No. 08/233,071, filed Apr. 26, 1994, now abandoned.

BACKGROUND OF THE INVENTION

1. Field of the Invention

This invention relates to an antenna for transmission and receipt of RF signals on a hand-held, portable cellular phone and in particular, to an improved antenna having reactance cancellation for improved antenna efficiency, improving the transmission and receipt signal efficiency, and reducing or eliminating the RF field immediately in contact with the cellular phone user.

2. Description of the Prior Art

Cellular telephones operating in the 800 to 1900 megacycle RF frequency range are well known in the art. More specifically cellular communication may occur in frequency ranges including 824–924 MHz, 1750–1870 MHz, 1750–1780 MHz, 1840–1870 MHz and other high frequency ranges which are being developed. In recent years, hand-held, portable cellular phones in these and other ranges have become quite common. However, problems which continue to exist include inadequate efficiency in signal transmission and signal radiation around and through the phone user at levels which have adverse health results. One deficiency in current hand-held, portable telephones is that numerous cell sites are required because of the limited range of each unit. Such hand-held cellular phone units also exhibit from time to time breakup and distortion in the signal receipt or transmission, and often, certain locations do not permit their use because of the total signal shadow. Cellular phones also radiate an RF wave pattern that typically includes a ground wave or negative signal that is transmitted around and through the user while the hand-held phone is in use; that is, while the phone unit is held to a person's ear to allow the person to hear or to talk while the device is radiating. A milligauss electromagnetic field detecting unit can be used around a cellular phone in use to show certain electromagnetic radiation patterns that are in contact with certain areas of the user's head and upper torso.

Typically, cellular phones use a Marconi-type antenna which has positive and negative wave patterns that include a ground wave. Conventional antennas are typically current-fed, two-element systems that use the phone case as a counterpoise or ground plane to help achieve impedance matching with the 50 ohm output impedance of the phone. Current fed systems normally comprise a parallel LC reactance circuit, having adjustable inductance, connected to a phone output. Examples of these antenna systems may be found in U.S. Pat. Nos. 3,474,453 issued to Ireland; 4,238,799 issued to Parfitt; 2,648,771 issued to Cork; 4,730,195 issued to Phillips, et al; 4,940,989 issued to Austin; 5,214,434 issued to Hsu; 5,214,437 issued to Hensler; and 3,155,751 issued to Roll, and German reference issued Nov. 4, 1981 to Koehler. As can be seen by Ireland and Koehler, the capacitor is typically connected electrically in parallel to the inductance by making a direct conductive link.

It is known that the impedance at the center of a conventional antenna is approximately 72 ohms, and that for maximum efficiency, the impedance of the phone should match the impedance of the signal output device. Thus, although the impedance at the center of a conventional antenna is approximately 72 ohms, the impedance approaches 50 ohms when the phone is hand-held because of the natural capacitance in one's body. Accordingly, RF wave energy is transmitted around and through the user's body. Recent studies show that this can be harmful to the user.

Experimental results suggests that AC electric and magnetic fields increase the risk of certain cancers and other physiological and psychological harms. Radiated signals from a cellular phone antenna surround the body with an electromagnetic field that can produce adverse results in the body. Based on recent studies, these fields are produced by cellular phone antennas which are typically current fed Marconi systems, as noted, that use the phone output as a ground return such that only 50% of the signal is transmitted away from the antenna. Current fed antennas comprise quarter-wave (¼ wavelength) antennas to match ¼ wavelength systems in conventional phones. In contrast, voltage fed antennas comprise ½ wavelength antennas which are capable of approaching full signal transmission, i.e. 100%, so as to limit or substantially eliminate a cellular phone user's exposure to that portion of signal typically left behind in quarter-wave antennas. The problem is that an antenna can not be voltage fed unless it is ½ wavelength and a ½ wavelength antenna can not be connected to a current fed ¼ wavelength system. Since conventional phones are ¼ wavelength current fed systems, ½ wavelength antennas can not be effectively used.

While the elimination of counterpoise has been addressed in the background art, the problems noted above have not been fully addressed. For instance, U.S. Pat. No. 3,474,453, issued Oct. 21, 1969 to F. E. Ireland, Applicant herein, shows a whip antenna with adjustable tuning that could be used to eliminate problems with the earth or surrounding structures for transmission purposes. U.S. Pat. No. 4,584,587, issued Apr. 22, 1986 to F. E. Ireland, Applicant herein, shows a tunable antenna with coupling at the input that can be used without a counterpoise.

It is desirous to improve cellular phone signal transmission to reduce the adverse affects of signal generated fields and one way to increase signal transmission efficiency would be to provide a ½ wavelength antenna that is operable in a ¼ wavelength cellular system. Therefore, there exists a need for an antenna system that is able to achieve antenna efficiency through impedance matching without radiating the actual user. The present invention overcomes problems in the prior art by providing an improved antenna having more efficient RF signal radiation transmission and receipt. The antenna system is used with a hand-held, portable cellular phone to increase signal efficiency, both in transmission and receipt distance range, to eliminate ground distortion or building structure distortion through improved signal efficiency, and to eliminate RF radiation patterns associated with ground waves from the body areas of the user of a hand-held, portable cellular telephone. The instant invention accomplishes its results with an antenna system that converts a ¼ wavelength system into a ½ wavelength system using reactance cancellation.

SUMMARY OF THE INVENTION

An improved antenna that can be readily attached to existing hand-held, portable cellular telephones, typically operating with 800 to 1900 megacycles and higher, said antenna being a ¾ wavelength voltage-fed system comprising a single element (wire), an elongated, linear RF radiating conductor sized at one-half wavelength having a free end and an anchored end, a first electrical connector connectable to an existing portable cellular telephone signal output, and a means for tuning the antenna circuit connected to the RF radiating conductor which includes a ¼ wavelength reactance cancellation circuit to create a predetermined wave pattern of RF energy. The instant invention comprises a ¾ wavelength antenna system that converts a ¼ wavelength system into a ½ wavelength system by incorporating a ¼ wavelength reactance cancellation circuit that allows a ½ wavelength radiating element to efficiently communicate with a ¼ wavelength system. The RF radiating conductor or antenna element is connected to the tunable tank/reactance cancellation circuit that provides impedance matching between the 50 ohm output impedance of the typical standard hand-held cellular phone with a 50 ohm input impedance in the device. The invention also includes a very high RF impedance element, preferably 2500 RF ohms and higher, which allows for maximum current radiation in the tuned resonant circuit with the filtering of the radiated signal and the creation of a ½ wave antenna through the employment of the high-Q reactance tank circuit between the antenna radiating element and phone or radio output/current feed point. The high Q tank/reactance circuit comprises an LC circuit connected at one end to the high RF impedance element and at the other end to the phone so as to allow the complete signal to be transmitted. The capacitance of the tank circuit is coupled directly to the phone case ground to filter any radiation which may pass through a user. The inductance is connected directly to the phone output. Thus, the tank circuit filters the ground return path that would otherwise pass through a user's body, thereby eliminating or preventing the RF energy from being conducted into the body of the user while transmitting the signal more efficiently.

As previously noted, transmitting and receiving devices use 72-ohm normal dipole antennas at the current feed or output point of the device which is designed to be reduced to 50 ohms by body contact to effect 50-ohm impedance matching. To achieve impedance matching with a body's actual capacitance, RF energy from the device passes through one's body. The reactance cancellator of the instant invention, however, comprises a high-Q resonant reactance cancellation circuit that experiences high RF impedance at the radiating end and low impedance at the current feed point to impedance match and leave a ½ wavelength radiating element that more fully transmits the desired signal away from the case, thereby eliminating RF energy on the body of the user.

The resonant circuit provides a known capacitance sleeve to achieve 50-ohm impedance matching between the antenna and the device output depending on the frequency of the signal when the capacitance is fully engaged. The capacitance sleeve may also define a variable capacitance element that is adjustable in that the capacitor conductive sleeve can be adjustably separated from the case and a conductive base/ground adapter. In either event, the sleeve and ground adapter are separated by a dielectric element. The variable capacitor is adjusted within the field of an inductance element. By adjusting the capacitor sleeve, a 50-ohm impedance match is obtained, the antenna is placed in resonance with the signal output, and the negative wave portion of the signal, or the complete signal, is transmitted so as to eliminate the user as a ground plane. Preferably, the size of the capacitance sleeve is predetermined to achieve the 50-ohm impedance match.

With the antenna connected in place to the output signal of the hand-held, portable cellular phone, signals are transmitted through a single antenna conductor that connects to the output of the cellular phone through an inductor winding which is supported by a non-conductive dielectric element/core. The dielectric support comprises a plastic tube for supporting the inductance winding in the reactive circuit. The dielectric support element is mounted between the radiating element/antenna and the conductive antenna base connector that connects to the phone ground. The radiating element/antenna is connected to the reactance cancellation circuit by a high impedance element. The high RF impedance element is physically attached to the dielectric support element and is preferably at least 2500 ohms. The radiating antenna is sized in length, approximately 7 inches, for a cellular phone, to achieve one-half wavelength of the desired transmitting and receiving frequency. Reactance cancellation is achieved through the high impedance radiating element and the high Q resonant tank/reactance cancellation circuit. The reactance cancellation circuit comprises capacitance and inductance connected to the ground and output of the phone, respectively, instead of in parallel as in the prior art. The antenna system of the instant invention includes a predetermined amount of capacitance in the circuit which is formed by spaced elements. The circuit elements of inductance and capacitance are balanced so that the output impedance of the cellular phone, which is approximately 50 ohms, includes a 50 ohm input impedance match in the device.

The antenna system in accordance with the present invention includes the high Q resonant tank circuit to achieve maximum signal current for transmission and reception. The high Q resonant tank circuit is preferably a ¼ wavelength circuit. The high RF impedance device, typically 2500 to 3500 ohms and higher, which fixes the connected end of the antenna/radiating element comprises the high impedance end of the ¼ wave length reactive circuit thus feeding the antenna radiating element where voltage is at its peak. At the signal input side of the reactive circuit, the impedance is low for matching the output impedance of the radio device, that is 50 ohms. At the output of the reactive circuit where the radiating element is fed, the RF impedance is high when measuring the voltage-to-current ratio. Without the reactive circuit there is no filtering so that the ground plane of the radio case counterpoise provides a ¼ wave length negative ground plane which radiates the RF energy in the ground plane through a holder's body. The instant invention comprises an antenna system which replaces the ¼ wave length ground plane present in the case with a ¼ wave length high-Q resonant tank circuit (reactive circuit) that diverts and filters the RF signal from the case before it passes to the user's body and allows for substantially full signal transmission from the ½ wavelength radiating element, thereby eliminating a person using the hand-held phone or radio as a conductive path. This is accomplished in part by grounding the capacitance, feeding the inductance with the signal output, and connecting the capacitance sleeve to the inductance at the point of the validating element. Thus, the instant invention prevents the signal from radiating around the person that is using the hand-held device.

Structurally, the antenna includes a conductive base connector that is connected directly to the transmitter and receiver antenna end fitting/mounting adaptor of the hand-held, which connects to the portable cellular phone signal output. The phone antenna mounting adaptor conventionally includes an output lead extending from the cellular phone. This output lead is connected to a single-feed element in the antenna. The instant invention incorporates a reactance tank circuit including high impedance for converting the antenna system to a voltage feed antenna system. Attached at the opposite end of the base fitting is a one or two part threaded or non-threaded female adaptor for receiving a dielectric support. The dielectric support supports the single wire inductance winding and includes a passage therethrough for receiving and passing the signal conductor that carries the output signal from the cellular phone to the radiating element as described herein. A second threaded female conductive fitting may threadably fit into the threaded female port of the conductive base. In such a setup, the second fitting includes the female adapter end for receiving and securing the dielectric support. The dielectric support preferably comprises a fiberglass or plastic cylindrically-shaped tube that has the single wire signal conductor wrapped around its outer periphery with at least one or two turns.

The high RF impedance element comprises a threaded conductive member electrically attached at one end to the single wire signal conductor and to the antenna radiating conductor/element at its opposite end by way of a threaded antenna connector. The high impedance element feeds the voltage into the base end of the antenna which is soldered to the threaded connector. The threaded connector is conductive and threadably mates with the high impedance element.

A large conductive sleeve rotatably fits over the inner dielectric support device and the high impedance elements and is attached to a non-conductive dielectric sleeve. The dielectric sleeve is threadably connected to the lower end of the conductive sleeve and fits over the inner dielectric support and upper portion of the conductive ground base. The dielectric sleeve separates the conductive sleeve from the conductive base creating the necessary capacitance between the cellular phone end fitting and the radiating conductor end.

In the present embodiment, capacitance and inductance is preset at the factory so that a conventional hand-held cellular phone antenna need merely be replaced without additional tuning. The system may employ a tunable capacitor, however, for changing the resonance from system to system. The device can also be set up for varying multiple proportional wavelengths, such as 1/32, 1/16, 1/8, 1/4, or 1/2 wavelength, depending on the values of the circuit elements utilized.

The device can also be operated using an equivalent tuned circuit which achieves the specific capacitance, inductance, reactance, and impedance described herein to eliminate the radiation RF signal through the reactance cancellation.

Reactance cancellation is achieved by the high impedance element at the anchored end of the antenna radiating conductor, which allows the signal to be efficiently radiated, eliminating the lower one-quarter wavelength typically found in conventional cellular phone transmission and receiving antennas.

Through the use of the present invention, the efficiency of the signal transmitted and received is increased almost twofold, thereby greatly increasing the range, eliminating blind spots or dead spots and distortion, and reducing or eliminating the radiation pattern of RF energy on the user who is holding a hand-held, portable cellular phone to the user's ear and mouth area.

It is an object of this invention to provide an improved antenna for a hand-held, portable cellular phone for increasing signal transmission and receiving efficiencies.

It is another object of this invention to provide an improved cellular phone antenna that reduces or eliminates surrounding RF energy into the body areas of the user during transmission or receipt of cellular telephone transmissions.

It is yet another object of this invention to improve the signal strength and efficiency of transmission through the use of a high impedance element for canceling reactance to change the RF transmission pattern for increasing the signal efficiency.

It is still another object of this invention is to create an improved antenna which can be used with multiple wavelengths, and multiples thereof, for increasing the efficiency and signal strength of a hand-held, portable cellular phone.

It is a further object of the invention to provide an antenna system that enables a 1/2 wavelength radiating element to be effectively communicated with a 1/4 wavelength system.

In accordance with these and other objects which will become apparent hereinafter, the instant invention will now be described with particular reference to the accompanying drawings.

DESCRIPTION OF THE PREFERRED EMBODIMENTS

Figure 1:
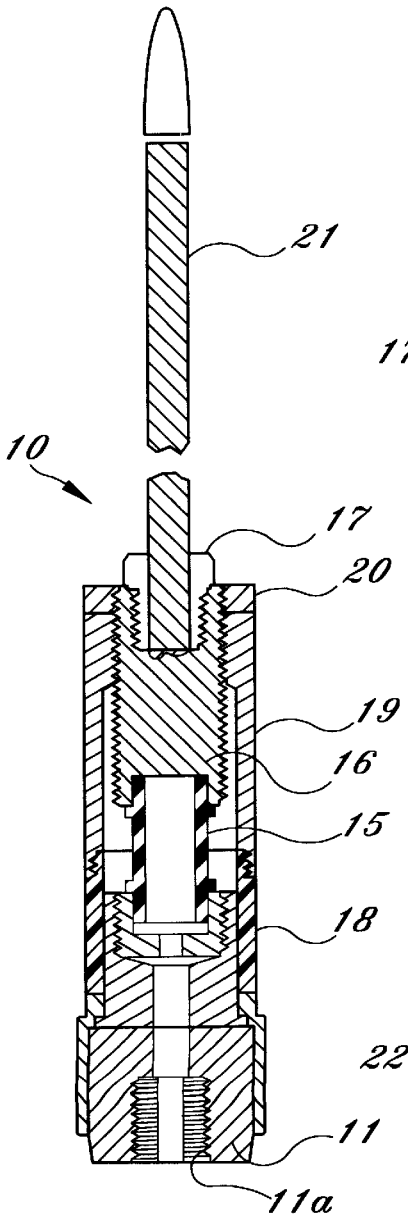
FIG. 1 is a side elevational view in cross section of the present invention, showing Applicant's improved antenna.
Figure 2:
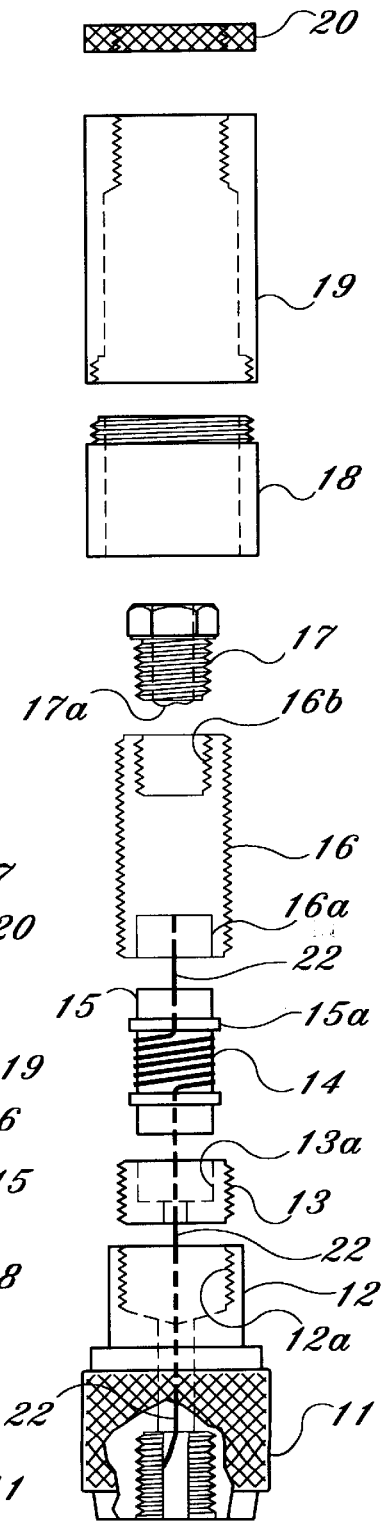
FIG. 2 is a side elevational view partially in cross section, showing an exploded view of the circuit elements and base connection used in Applicant's invention.

Referring now to the drawings, and in particular FIGS. 1 and 2, the present invention is shown generally at 10, which is an antenna used with a portable cellular phone (not shown).

FIG. 1 shows a conductive base connector 11 which is cylindrical and has a threaded internal channel 11*a* that connects to a conventional antenna outlet adaptor in a hand-held, portable cellular telephone.

In FIG. 2, a single-wire conductor 22 carries the signal from the outlet of the cellular phone jack or connection through a passage defined by the conductive base connector 11 to the conductive high impedance element 16, antenna support 17 and the radiating element 21, as described herein. The conductor 22 is electrically connected to the output of the cellular phone when base connector 11 is attached to the cellular phone. The base connector 11 is conductive and includes an upper smaller cylindrical mount referenced herein as a conductive ground adaptor 12. The conductive ground adaptor 12 includes a threaded, cylindrical, interior well 12*a* for receiving a core adaptor 13 which may be dielectric or conductive. The core adaptor 13 includes a female port to hold a core dielectric 15, which comprises a fiberglass or plastic cylinder for supporting the conductor 22 on its outer surface to form inductor winding 14. The foregoing combination is firmly secured to the base connector 11, as seen in FIG. 2. Base connector 11 includes a channel disposed therethrough that receives and passes the conductor 22. The core adapter 13 also has a cylindrical chamber 13*a* that snugly receives one end of the core dielectric 15. The core dielectric 15 has raised portions 15*a* that act as a stop when connected to the dielectric core adapter 13. The core dielectric 15 has at least one or two turns of the conductor 22 about its outer periphery to form inductance winding 14.

A high RF impedance element 16 joins the radiating element 21 to the dielectric core 15 and comprises a conductive antenna connector having threaded portions on its outside and two end chambers 16*a*, 16*b*, one threaded 16*b* and one smooth 16*a*. The smooth chamber 16*a* is for receiving an upper end of the core dielectric 15 opposite the end supported by chamber 13*a* to hold it in place. Element 16 is connected to the radiating element 21, as seen in FIGS. 1 and 2, at the high impedance side of the reactive circuit 23, where the radiating element experiences peak voltage and high impedance. At its opposite end, element 16 is electrically connected to one end of conductor 22 which carries the signal from the cellular phone. The antenna conductive radiating element 21 is anchored into a connector nut 17 and soldered at the base with solder 17*a* so that the antenna radiating conductor 21 is firmly attached to the connecting nut 17. The antenna's connector nut 17 is threadably connected into the chamber 16*b* and is conductively attached to the base end of the antenna. This is the single-feed end which is attached electrically to element 16, which is a conductor and to the feed end of conductor 22. A substantially non-conductive dielectric sleeve 18 fits over the conductive ground adapter 12 and attaches to the antenna base connector 11 at one end and to a conductive sleeve 19 at an opposite end. The conductive sleeve 19 fits over and attaches threadably to element 16. Sleeve 19 and base/grounding element 11 provide the capacitance in the reactive circuit 23. The sleeve 19 is separated from the ground base connector 11 by a dielectric sleeve 18, which is also hollow, and possibly threaded in the center. The capacitance formed by the sleeve 19 and base 11 is grounded to the phone case by the attaching the base 11 to the phone's antenna end fitting/mounting adaptor. By contrast, the inductance winding 14 is connected directly to the phone signal output. Together, the reactance tank circuit 23 is formed by the combination of these elements. The resonating frequency of the reactive circuit 23 is adjusted by the capacitance sleeve 19 for achieving impedance matching and reactance cancellation. The capacitance of the circuit is preset to a known value when the sleeve 19 and dielectric 18 fully engage the base mount 12. The reactive circuit 23 cancels reactance to place the ground plane 90 degrees above the signal feed point so that substantial radiation does not pass through the user. This is because the signal is more efficiently radiated, unlike in prior art devices. A threaded lock nut 20 locks sleeve 19 and the remaining elements in place to the base connector 11.

Shown in FIG. 1 and FIG. 2, the initial conductor and antenna base connector 11 is impedance matched at 50 ohms to the output of the cellular telephone signal, which is 50 ohms by adjusting the capacitance sleeve 19 which changes the relationship between the electric field of the capacitance 19/12,11 and the magnetic field of the inductor winding 14. Conductor 22 carries the signal through an inductor 14 to the high RF impedance feed element 16 (preferably at least 2500 RF ohms) which links high impedance to the base end of the antenna and the output of the reactive circuit 23. This provides for reactance cancellation of undesirable reactances and facilitates full signal transmission to prevent transmission into a person. Accordingly, the signal is more fully radiated away from the phone such that it resonates above the case as a result of the reactive circuit 23 instead of passing through the user. The antenna conducting radiating element 21 is a ½ wavelength single element, rigid rod of conductive material that is voltage fed at its fixed end by the single-element conductor 22.

Figure 3:
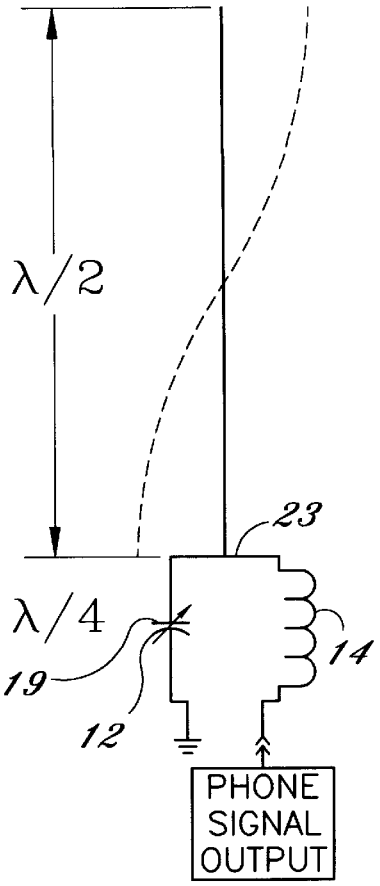
FIG. 3 shows a circuit diagram equivalent of the instant invention.

FIG. 3 shows the equivalent circuit of the invention including the one-half wave pattern where the voltage is at a maximum at the base of the antenna and at the tip of the antenna, with a zero node halfway in between. The tank circuit 23 includes a variable conductance 19/12,11 that represents a one-quarter wavelength feed to the one-half wavelength antenna 21 allowing the ½ wave radiating element 21 to communicate with the ¼ wave system in the phone output.

Figure 4:
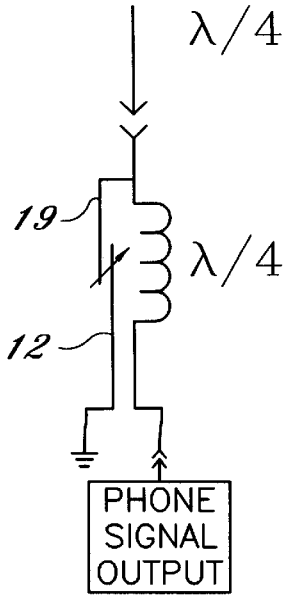
FIG. 4 shows a circuit diagram for use in explaining Applicant's invention.

FIG. 4 shows a similar device that could be used with multiple wavelengths, including a one-quarter wavelength antenna as fed by a one-quarter wavelength circuit.

Note that the circuit elements are chosen again to allow high impedance at the base end of the antenna and to provide a tuning circuit 23 comprising capacitance sleeve 19, dielectric sleeve 18, ground base 11, and inductor winding 14 for achieving resonance of the transmitting element 21 by impedance matching through adjustment of sleeve 19 over impedance element 16 to get maximum radiation. Although the device is specifically shown with a pre-tunable antenna that can be tuned once at the factory to be used with a specific frequency for a hand-held, portable cellular telephone, equivalent circuits are available to produce the same electrical results as is known in the art.

Through the use of this antenna, Applicant provides a more efficient high-Q ¼ wavelength reactive circuit at the high impedance end of the antenna to join the ½ wave antenna 21 to the ¼ wavelength radio output. The RF electromagnetic field is no longer experienced by the user of a hand-held device incorporating the instant invention when the device of a cellular phone is placed to the ear and mouth areas of the user because the RF voltage pattern from the phone or radio case resonates above the communication device case with the high-Q reactance cancellator circuit 23. The present invention therefore eliminates the adverse health effects of cellular phone usage. In addition, the antenna radiation portion is highly directive because of this change in radiation pattern to allow more energy to be dedicated toward the transmission of the signal in the preferred direction for the various cell units for a cellular telephone. Because of the increased efficiency both in radiation and reception using this antenna, it is believed that the number of actual cell sites in a particular area for the cellular telephone can be greatly reduced. It is also believed that reception and transmission using a stronger signal will thus be more beneficial, increasing the range of a cellular telephone and eliminating dead spots in certain areas because of signal strength.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A ¾ wavelength antenna for use on a hand-held, portable cellular telephone having an antenna mounting adaptor that receives said antenna, encloses a signal output and provides an electrical ground at the telephone for receiving and transmitting communication related signals, operating at at least 800 MHz, said antenna comprising:

a non-conducting dielectric core having a top end and a bottom end;

a ½ wavelength antenna radiating element;

a conductive support electrically connected to said antenna radiating element and mounted to said core top end for physically supporting said antenna radiating element;

a reactance cancellation circuit electrically connected to said antenna radiating element and having an impedance for voltage feeding the signal output to said antenna radiating element, for filtering the signal output to facilitate substantially full signal transmission from said antenna radiating element and away from the telephone and for substantially eliminating residual signal radiation around the telephone, said circuit including an inductance winding supported by said core and electrically connected in series to the signal output at one end and to a capacitance and said radiating element at the opposite end, said reactance cancellation circuit for cancelling reactance to place a ground plane, electrically, 90° above the signal feed point so that substantial radiation does not pass through the cell phone user;

said capacitance and inductance winding providing impedance matching of said antenna radiating element with impedance at the signal output, said capacitance having a first conductive element electrically connected to said inductance and said radiating element at said opposite end and a second conductive element electrically connected to the telephone electrical ground, said capacitance first and second conductive elements being separated by a dielectric sleeve; and means for mounting said antenna radiating element to said conductive support.

2. An antenna system as recited in claim 1, wherein said conductive support comprises a conductive sleeve having a threaded exterior periphery for threadably mounting said capacitance.

3. An antenna system as recited in claim 2, wherein said first conductive element comprises a capacitance sleeve element threadably mounted to said conductive support, said dielectric sleeve being threadably engaged with a lower end of said conductive sleeve for separating said capacitance sleeve from said second conductive element, said dielectric sleeve limiting the threadable engagement of said capacitance sleeve with said conductive sleeve for achieving a predetermined capacitance limitation for impedance matching; and said second conductive element comprising a conductive base support threadably mountable to the antenna mounting adapter so as to be in electrical contact with the electrical ground.

4. An antenna system as recited in claim 3, wherein said conductive base support comprises:

a first threaded port for threadably receiving said mounting means, said mounting means comprising a threaded bolt conductively attached to said antenna radiating element; and an adapter port defining an opening adaptable for receiving said core top end.

5. An antenna system as recited in claim 3, wherein said second conductive element defines a passageway for feeding said inductance winding and electrically connecting said inductance winding to the telephone signal output.

6. An antenna system as recited in claim 5, wherein said core defines an aperture in communication with said passageway for passing said inductance winding into said passageway.

7. A ¾ wavelength antenna system for a ¼ wavelength hand-held portable cellular telephone having an antenna mounting adaptor that receives said antenna, encloses a signal output and provides an electrical ground for receiving and transmitting communication related signals, operating at at least 800 MHz, said antenna system comprising:

a non-conducting dielectric core having a top end and a bottom end;

a half wavelength antenna radiating element;

a conductive antenna support attached to the top end of said core for supporting said antenna radiating element, said conductive antenna support being in electrical communication with said antenna radiating element;

an inductance winding forming at least two inductive turns around said core, said winding having a first end electrically connected to said conductive antenna support and a second end electrically connected to the telephone signal output; and a variable capacitor comprising a conductive ground adapter, a conductive capacitance sleeve and a dielectric sleeve;

said conductive ground adaptor being adaptable for mounting to the telephone mounting adaptor and for supporting said non-conducting dielectric core, said conductive ground adapter being electrically connected to the telephone electrical ground when mounted to the telephone mounting adaptor;

said conductive capacitance sleeve being electrically connected between said antenna radiating element and the telephone electrical ground, said conductive capacitance sleeve being threadably mounted to said conductive antenna support for electrically connecting to said inductance winding, said capacitance sleeve, said dielectric sleeve separating said capacitance sleeve and said conductive ground adaptor, said capacitor element and said inductance winding having a capacitance and inductance rating, respectively, for forming a ¼ wavelength reactance cancellation circuit that voltage feeds the signal output to said antenna radiating element and performs impedance matching, said capacitance sleeve being threadably adjustable for adjusting reactance in said reactance cancellation circuit to match impedance in said antenna radiating element with impedance at the telephone signal output, said reactance cancellation circuit for cancelling reactance to place a ground plane, electrically, 90° above the signal feed point so that substantial radiation does not pass through the cell phone user.

8. An antenna system as recited in claim 7, wherein said inductance winding experiences high impedance at said first end and low impedance at said second end.

9. An antenna system as recited in claim 8, wherein said dielectric sleeve is threadably joined to said capacitance sleeve, and adaptably mounts over said conductive ground adaptor.

10. An antenna system as recited in claim 9, wherein said conductive antenna support comprises at least 2500 ohms when said antenna radiating element radiates signals.

11. An antenna system as recited in claim 10, wherein said conductive ground adaptor defines a well for receiving and supporting said dielectric core.

12. A ¾ wavelength antenna system for a hand-held, portable cellular telephone having an antenna mounting adaptor that receives said antenna, encloses a signal output and provides an electrical ground for receiving and transmitting communication related signals, operating at at least 800 MHz, said antenna system comprising:

a non-conducting dielectric core having a top end and a bottom end;

a ½ wavelength antenna radiating element;

a conductive support electrically connected to said antenna radiating element and mounted to said core top end for physically supporting said antenna radiating element; and a ¼ wavelength reactance cancellation circuit for voltage feeding the signal output to said antenna radiating element, for allowing said ½ wavelength antenna radiating element to communicate with the cellular telephone signal output, for filtering the signal output to facilitate substantially full signal transmission from said antenna radiating element and for transferring electrical ground above the telephone, said circuit comprising an inductance winding serially connected to a variable capacitance means for matching impedance of said antenna radiating element with impedance at the signal output, said reactance cancellation circuit for cancelling reactance to place a ground plane, electrically, 90° above the signal feed point so that substantial radiation does not pass through the cell phone user;

said inductance winding being supported by said core and electrically connected between the signal output at one end and said conductive support at an opposite end;

said variable capacitance means being electrically connected between said conductive support and the telephone electrical ground such that said capacitance means and inductance winding are serially connected, said capacitance means being adjustably connected to said conductive support for varying capacitance in said reactance cancellation circuit.

13. An antenna system as recited in claim 12, wherein said variable capacitance means comprises:

a first conductive element electrically connected to said conductive support and said inductance winding at said opposite end, a second conductive element electrically in communication with the telephone electrical ground and a dielectric sleeve separating said first and second conductive elements a predetermined distance.

14. An antenna system as recited in claim 13, wherein said conductive support comprises a conductive sleeve having a threaded exterior periphery for threadably mounting said capacitance means.

15. An antenna system as recited in claim 14, wherein said first conductive element comprises a capacitance sleeve element threadably mounted to said conductive support, said dielectric sleeve being threadably engaged with a lower end of said conductive sleeve for separating said capacitance sleeve from said second conductive element, said second conductive element comprising a conductive base support threadably mountable to the antenna mounting adapter so as to be in electrical contact with the electrical ground.

16. An antenna system as recited in claim 15, wherein said second conductive element defines a passageway for feeding said inductance winding and electrically connecting said inductance winding to the telephone signal output.

17. An antenna system as recited in claim 16, wherein said core defines an aperture in communication with said passageway for passing said inductance winding into said passageway.

* * * * *